US006185493B1

(12) United States Patent
Skinner et al.

(10) Patent No.: US 6,185,493 B1
(45) Date of Patent: Feb. 6, 2001

(54) METHOD AND APPARATUS FOR CONTROLLING AN IMPLEMENT OF A WORK MACHINE

(75) Inventors: Thomas G. Skinner, Aurora; Hans P. Dietz, Naperville, both of IL (US)

(73) Assignee: Caterpillar Inc., Peoria, IL (US)

( * ) Notice: Under 35 U.S.C. 154(b), the term of this patent shall be extended for 0 days.

(21) Appl. No.: 09/267,542

(22) Filed: Mar. 12, 1999

(51) Int. Cl.[7] ..... F15B 13/16
(52) U.S. Cl. ..... 701/50; 91/361
(58) Field of Search ..... 701/50; 414/699; 91/361, 513

(56) References Cited

U.S. PATENT DOCUMENTS

| | | | | |
|---|---|---|---|---|
| 4,037,742 | | 7/1977 | Gustafsson | 214/138 R |
| 4,552,503 | | 11/1985 | Mouri et al. | 414/687 |
| 4,712,376 | * | 12/1987 | Hadank et al. | 60/427 |
| 4,869,635 | | 9/1989 | Krahn | 414/274 |
| 4,942,529 | | 7/1990 | Avitan et al. | 364/424.01 |
| 4,964,779 | | 10/1990 | Sagaser | 414/708 |
| 5,188,502 | | 2/1993 | Tonsor et al. | 414/700 |
| 5,208,753 | | 5/1993 | Acuff | 364/424.07 |
| 5,245,137 | | 9/1993 | Bowman et al. | 177/139 |
| 5,613,581 | | 3/1997 | Fonkalsrud et al. | 192/3.23 |
| 5,701,793 | | 12/1997 | Gardner et al. | 91/361 |
| 5,807,061 | | 9/1998 | Donoghue et al. | 414/710 |
| 5,953,977 | * | 9/1999 | Krishna et al. | 91/361 |

* cited by examiner

*Primary Examiner*—Michael J. Zanelli
(74) *Attorney, Agent, or Firm*—David M. Masterson; Liza J. Meyers

(57) ABSTRACT

An apparatus for controllably moving a work implement of an earth moving machine is disclosed. The work implement includes a boom and a bucket being attached thereto where the boom is actuated by a hydraulic lift cylinder and the bucket is actuated by a hydraulic tilt cylinder. An operator controlled joystick produces an operator command signal for controlling the movement of the work implement. Implement position sensors sense the elevational position of the boom and the pivotal position of the bucket, and responsively produce respective implement position signals. A controller receives the implement position and operator command signals, determines the instant position of the work implement, reduces the operator command signal as the boom is being raised and the bucket is being pivoted, and produces an electrical valve signal based on the reduced operator command signal. A valve assembly receives the electrical valve signal and controllably provides hydraulic fluid flow to the respective hydraulic cylinders in response to a magnitude of the electrical valve signal.

19 Claims, 5 Drawing Sheets

METHOD AND APPARATUS FOR CONTROLLING AN IMPLEMENT OF A WORK MACHINE

TECHNICAL FIELD

This invention relates generally to a method and apparatus for controlling the movement of a work implement of a work machine and, more particularly, to an apparatus and method that controls the movement of the work implement based on the work implement position and operator command.

BACKGROUND ART

Work machines such as wheel type loaders include work implements capable of being moved through a number of positions during a work cycle. Such implements typically include buckets, forks, and other material handling apparatus. The typical work cycle associated with a bucket includes sequentially positioning the bucket and associated lift arm in a digging position for filling the bucket with material, a carrying position, a raised position, and a dumping position for removing material from the bucket.

Control levers are mounted at the operator's station and are connected to an electrohydraulic circuit for moving the bucket and/or lift arms. The operator must manually move the control levers to open and close electrohydraulic valves that direct pressurized fluid to hydraulic cylinders which in turn cause the implement to move. For example, when the lift arms are to be raised, the operator moves the control lever associated with the lift arm hydraulic circuit to a position at which a hydraulic valve causes pressurized fluid to flow to the head end of a lift cylinder, thus causing the lift arms to rise. When the control lever returns to a neutral position, the hydraulic valve closes and pressurized fluid no longer flows to the lift cylinder.

In normal operation, the work implement is often abruptly started or brought to an abrupt stop after performing a desired work cycle function, which results in rapid changes in velocity and acceleration of the bucket and/or lift arm, machine, and operator. This can occur, for example, during a dumping operation when the bucket is moved to the end of its desired range of motion in a dumping position and the boom is quickly raised. This will impose excessive forces to the physical dump stops located on the boom.

These forces may damage the boom, as well as, damage the associated hydraulic circuitry that absorbs some of the shock that travels through the linkage assembly. This will likely increase maintenance and accelerated failure of the associated parts.

The present invention is directed to overcoming one or more of the problems as set forth above.

DISCLOSURE OF THE INVENTION

In one aspect of the present invention, an apparatus for controllably moving a work implement is disclosed. The work implement includes a boom and a bucket being attached thereto where the boom is actuated by a hydraulic lift cylinder and the bucket is actuated by a hydraulic tilt cylinder. An operator controlled joystick produces an operator command signal for controlling the movement of the work implement. Implement position sensors sense the elevational position of the boom and the pivotal position of the bucket, and responsively produce respective implement position signals. A controller receives the implement position and operator command signals, determines the instant position of the work implement, reduces the operator command signal as the boom is being raised and the bucket is being pivoted, and produces an electrical valve signal based on the reduced operator command signal. A valve assembly receives the electrical valve signal and controllably provides hydraulic fluid flow to the respective hydraulic cylinders in response to a magnitude of the electrical valve signal.

BRIEF DESCRIPTION OF THE DRAWINGS

For a better understanding of the present invention, reference may be made to the accompanying drawings in which.

BEST MODE FOR CARRYING OUT THE INVENTION

Figure 1:
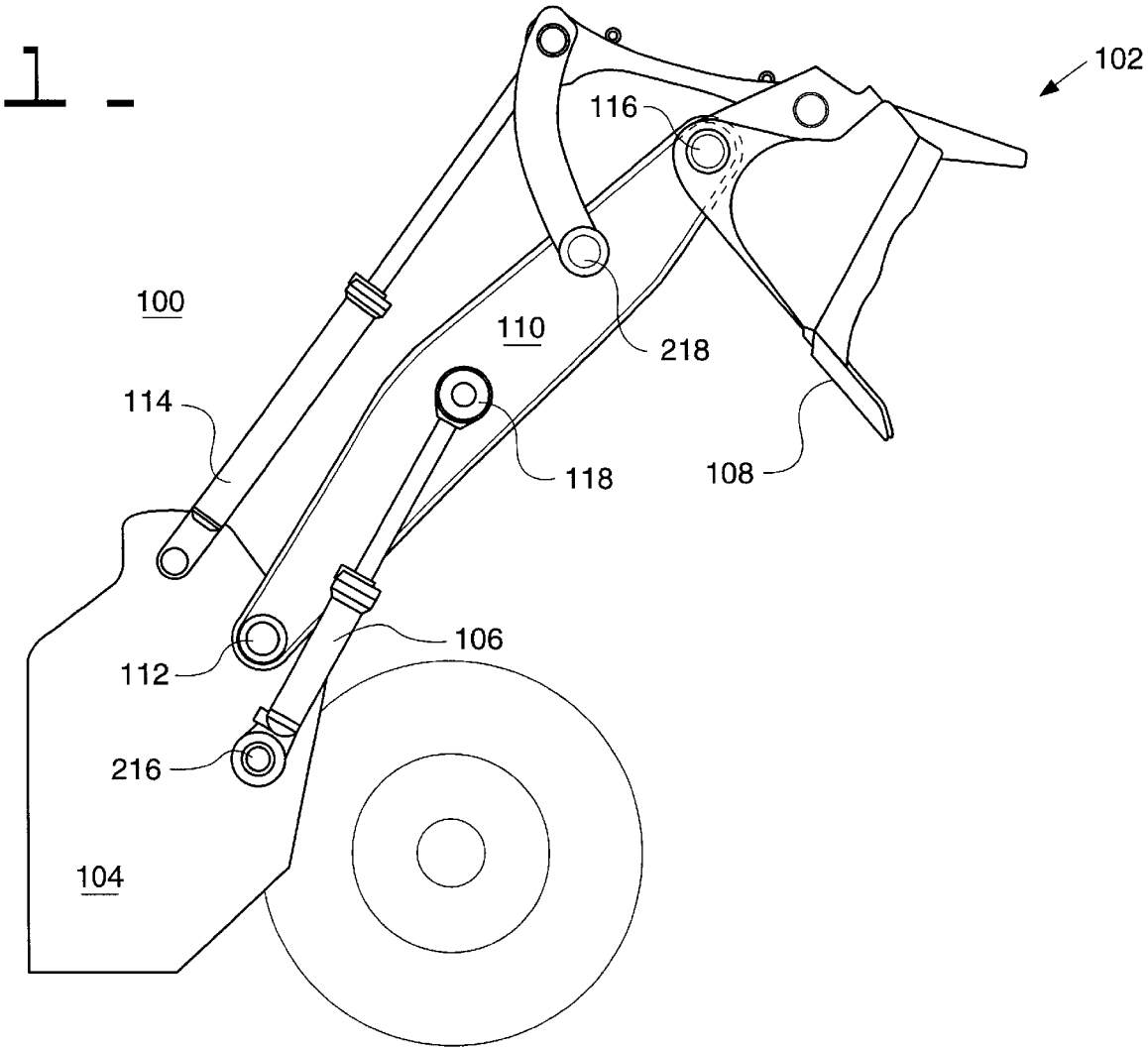
FIG. 1 is a side view of a forward portion of a loader machine or wheel type loader during a dumping operation.

FIG. 1 shows a forward portion 100 of a wheel type loader machine 104 having a payload carrier in the form of a bucket 108. Although the present invention is described in relation to a wheel type loader machine, the present invention is equally applicable to many earth working machines such as track type loaders, hydraulic excavators, and other machines having similar loading implements. The bucket 108 is connected to a lift arm assembly or boom 110, which is pivotally actuated by two hydraulic lift actuators or cylinders 106 (only one of which is shown) about a boom pivot pin 112 that is attached to the machine frame. A boom load bearing pivot pin 118 is attached to the boom 110 and the lift cylinders 106. The bucket 108 is tilted by a bucket tilt actuator or cylinder 114 about a tilt pivot pin 116.

Figure 2:
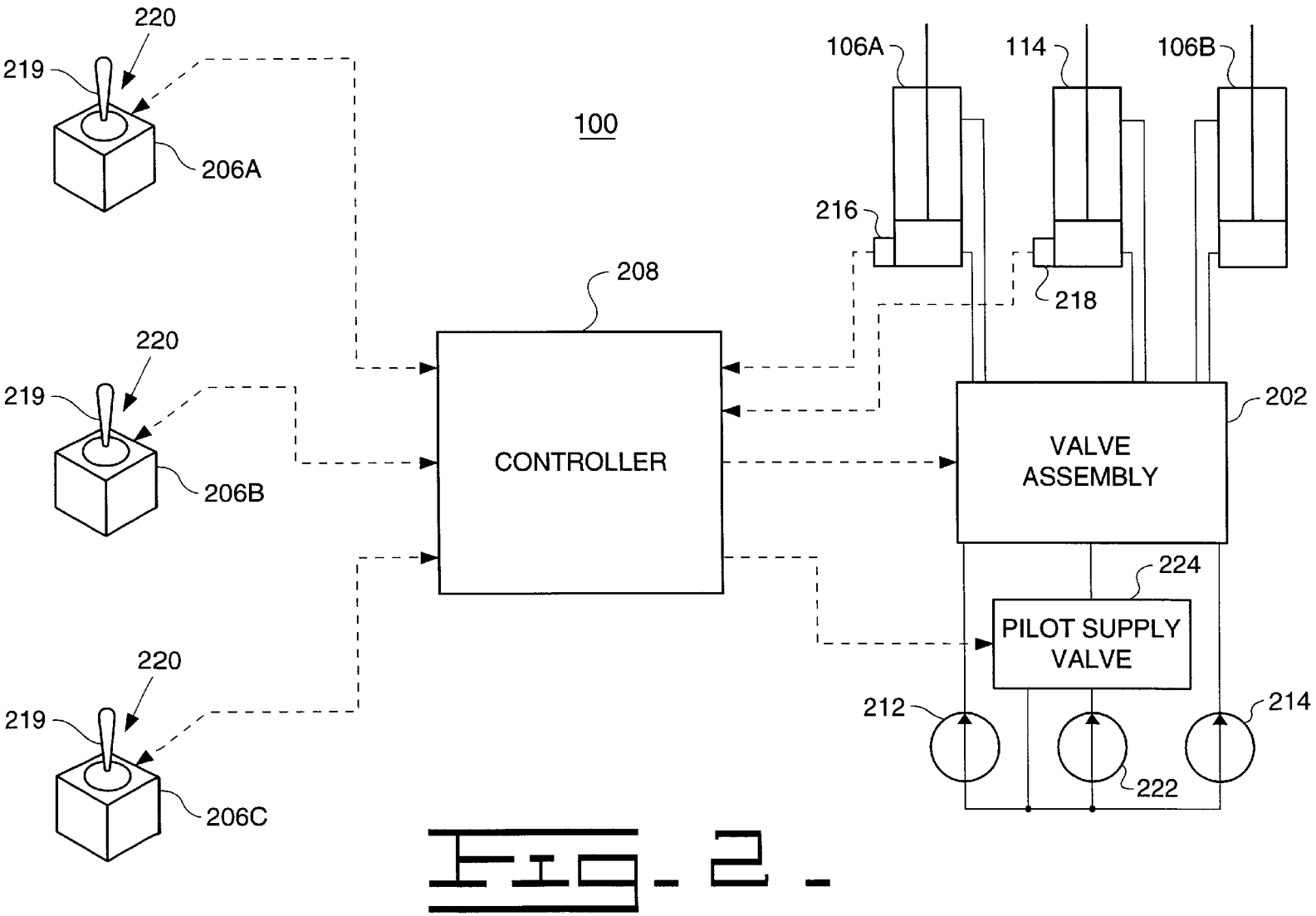
FIG. 2 is a block diagram of an electrohydraulic control system of the loader machine.

With reference to FIG. 2, the implement control system 100 as applied to a wheel type loader is diagrammatically illustrated. The implement control system is adapted to sense a plurality of inputs and responsively produce output signals which are delivered to various actuators in the control system. Preferably, the implement control system includes a microprocessor based controller 208.

First, second, and third joysticks 206A,206B,206C provide operator control over the work implement 102. The joysticks include a control lever 219 that has movement along a single axis. However, in addition to movement along a first axis (horizontal), the control lever 219 may also move along a second axis which is perpendicular to the horizontal axis. The first joystick 206A controls the lifting operation of the boom 110. The second joystick 206B controls the tilting operation of the bucket 108. The third joystick 206C controls an auxiliary function, such as operation of a special work tool.

A joystick position sensor 220 senses the position of the joystick control lever 219 and responsively generates an electrical operator command signal. The electrical signal is delivered to an input of the controller 208. The joystick position sensor 220 preferably includes a rotary potentiometer which produces a pulse width modulated signal in response to the pivotal position of the control lever; however, any sensor that is capable of producing an electrical signal in response to the pivotal position of the control lever would be operable with the instant invention.

An implement position sensor 216,218 senses the position of the work implement 102 with respect to the work machine 104 and responsively produces a plurality of implement position signals. The implement position signals are a function of the position of the respective hydraulic cylinders 106,114, and are indicative of the amount of the respective hydraulic cylinder extension. In the preferred embodiment, the position sensor 216,218 includes a lift position sensor 216 for sensing the elevational position of the boom 110 and a tilt position sensor 218 for sensing the pivotal position of the bucket 108.

In one embodiment, the lift and tilt position sensor 216,218 include rotary potentiometers. The rotary potentiometers produce pulse width modulated signals in response to the angular position of the boom 110 with respect to the vehicle and the bucket 108 with respect to the boom 110. The angular position of the boom is a function of the lift cylinder extension 106A,B, while the angular position of the bucket 108 is a function of both the tilt and lift cylinder extensions 114,106A,B. The function of the sensing means 216,218 can readily be any other sensor which are capable of measuring, either directly or indirectly, the relative extension of a hydraulic cylinder. For example, the rotary potentiometers could be replaced with magnetostrictive sensors or linear position potentiometers used to measure the sense the extension of the hydraulic cylinders.

A valve assembly 202 is responsive to electrical signals produced by the controller and provides hydraulic fluid flow to the hydraulic cylinders 106A,B,114.

In the preferred embodiment, the valve assembly 202 includes two main valves (one main valve for the lift cylinder and one main valve for the tilt cylinder) and four hydraulic actuator valves (two for each main valve). The main valves direct pressured fluid to the cylinders 106A,B, 114 and the hydraulic actuator valves direct pilot fluid flow to the main valves. Each hydraulic actuator valve is electrically connected to the controller 208. An exemplary hydraulic actuator valve is disclosed in U.S. Pat. No. 5,366,202 issued on Nov. 22, 1994 to Stephen V. Lunzman, which is hereby incorporated by reference. Two main pumps 212,214 are used to supply hydraulic fluid to the main spools, while a pilot pump 222 is used to supply hydraulic fluid to the hydraulic actuator valves. An on/off solenoid valve and pressure relief valve 224 are included to control pilot fluid flow to the hydraulic actuator valves.

The present invention is directed toward determining an electrical valve signal magnitude to accurately control the work implement movement. The controller 208 preferably includes RAM and ROM modules that store software programs to carry out certain features of the present invention. Further, the RAM and ROM modules store a plurality of look-up tables that are used to determine the electrical valve signal magnitude. The controller 208 receives the implement position and operator command signals, modifies the operator command signal, and produces an electrical valve signal having a magnitude that is responsive to the modified operator command signal. The valve assembly 202 receives the electrical valve signal, and controllably provides hydraulic fluid flow to the respective hydraulic cylinder in response to a magnitude of the electrical valve signal.

Figure 3:
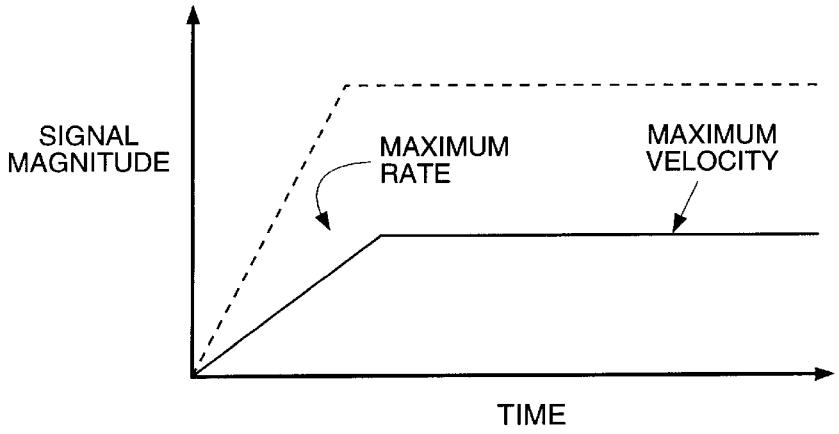
FIG. 3 is a block diagram of an electronic control system of the loader machine.

The magnitude of the electrical valve signal is determined by multiplying a scaling factor by the magnitude of the operator command signal. For example, the scaling factor may have a value ranging from 0 to 100%. This aspect of scaling results in a reduction in the maximum rate (of the work implement movement) that the operator may command, and a reduction in the overall maximum velocity (of the work implement movement) that the operator may command. This is shown by the graph illustrated in FIG. 3. The operator command signal is shown in the dashed line, and the electrical valve signal is shown in the solid line.

Figure 4:
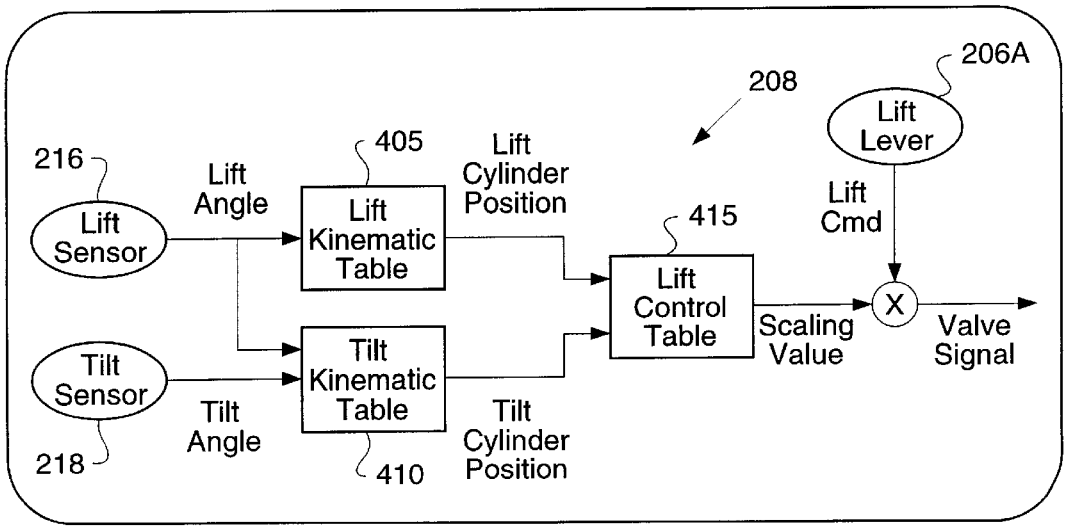
FIG. 4 shows a graph illustrating an operator command signal and an electrical valve signal over time.

The functionality of the controller 208 is shown in the block diagram of FIG. 4. The position of the lift cylinders 106, 108 are determined by converting angular information into linear positional information via a lift and tilt kinematic tables 405,410. For example, the kinematic tables 405,410 represent two-dimensional look-up tables that store a plurality of angular values that correspond to a plurality of cylinder positions. A lift control table 415 receives lift and tilt cylinder positional information and produces a scaling value. The scaling value is multiplied by the operator lift command to produce an electrical valve signal that reduces the velocity of the boom 110 during either lifting or lowering operations.

Figure 5:
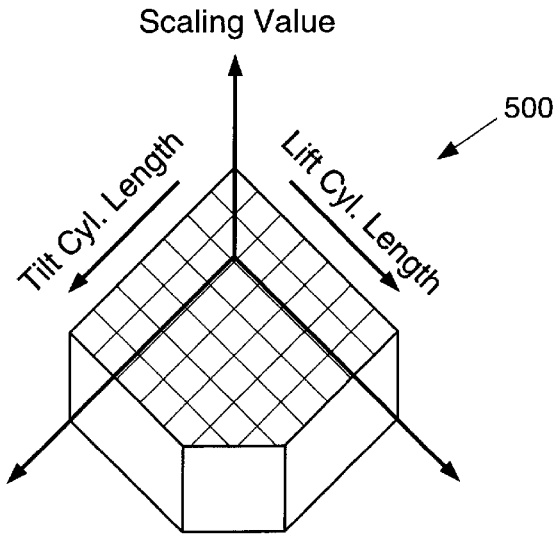
FIG. 5 represents one embodiment of a software look-up table associated with a lifting function.

Referring now to FIG. 5, one embodiment of the lift control table 500 is shown. The lift control table 500 represents a three-dimensional look-up table that stores a plurality of scaling values that correspond to the position of the lift and the tilt cylinders 106,114. The scaling values are chosen to limit the velocity of the boom 110 as both the lift and tilt cylinders 106,114 reach predetermined lengths. Although a scaling value is described, a limiting value can equally be used as would be apparent to one skilled in the art.

The scaling values are chosen to provide for an automatic velocity limiting effect when the bucket 108 is in a dumping position and the boom 110 is being raised to prevent the bucket 108 from pivoting into the boom 110 with a great amount of force. As shown in FIG. 1, this may occur as the bucket 108 pivots or tilts downwardly causing the bucket dump stops (not shown) located on the bottom, rear portion of the bucket 108 to strike the boom dump stops (not shown) located on the boom 110. Advantageously, the velocity limiting effect of the present invention reduces the structural loading on the boom, the forces imposed on the cylinders, and thus, the harsh "jerk" felt by the operator.

Figure 6:
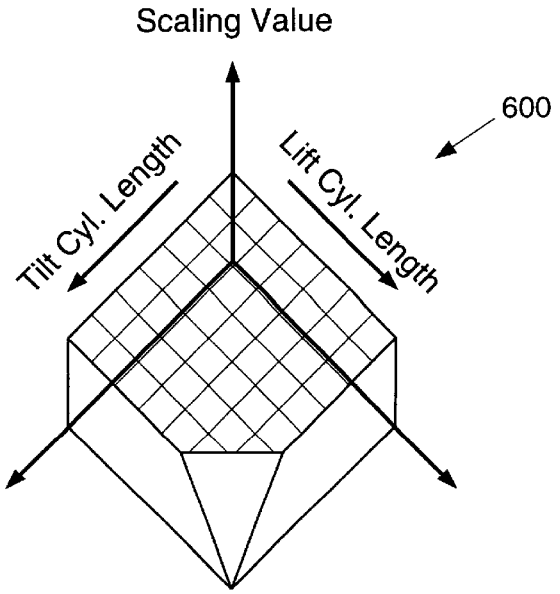
FIG. 6 represents another embodiment of a software look-up table associated with a lifting function.

Referring to FIG. 6, another embodiment of the lift control table 500 is shown. The embodiment shown in FIG. 5 represents a fast responding control where the movement of the boom 110 is quickly stopped as the bucket pivots within a predetermined distance of the boom. Contrast the embodiment shown in FIG. 5 with the embodiment shown in FIG. 6, where the movement of the boom 110 is gradually slowed as the bucket pivots within a predetermined distance of the boom. The embodiment in FIG. 6 may be used to prevent the bucket from striking the boom, or provide for a soft cushioning effect when the bucket strikes the boom. It is noted that either of the embodiments shown may be used to (1) prevent the bucket from striking the boom, (2) limit the velocity of the boom prior to the bucket striking the boom (to allow for a predetermined amount of striking force to expel material from the bucket) or (3) limit the movement of the boom once the bucket is in pivotal contact with the boom.

Figure 7:
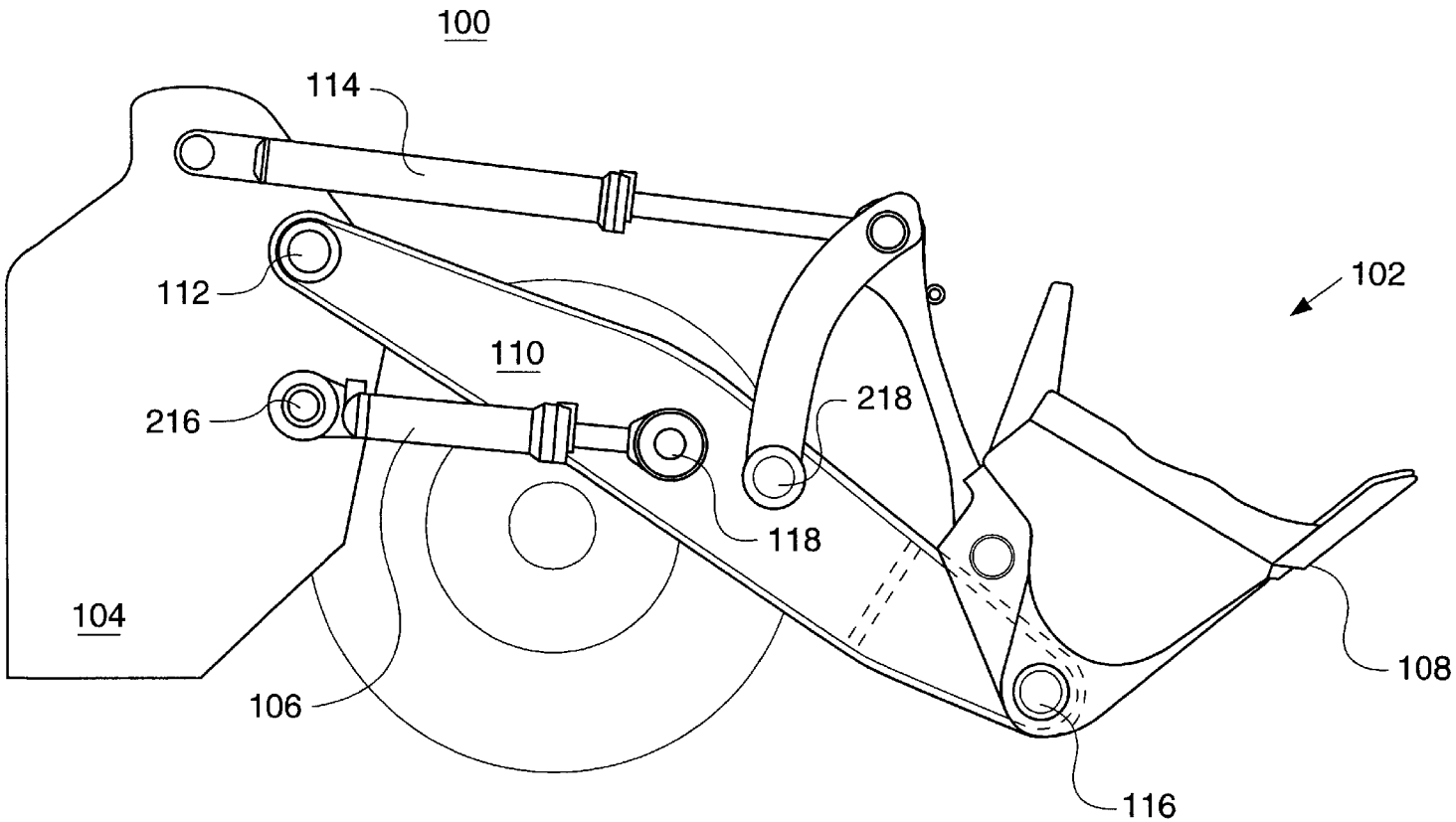
FIG. 7 is a side view of a forward portion of a loader machine or wheel type loader during a lowering operation.

Reference is now made to FIG. 7 which illustrates a lowering operation. The present invention can also be used to slow the velocity of the boom 110 as the boom 110 is being lowered in response to the bucket 108 being pivoted to a racked back position. The controller 208 via the lift control table 415 produces a scaling value that is multiplied by the operator lift command to produce an electrical valve signal that reduces the velocity of the boom 110 during the lowering operation. In this embodiment, the lift control table 415 represents a three-dimensional look-up table that stores a plurality of scaling values that correspond to the position of the lift and the tilt cylinders 106,114. The scaling values are chosen to limit the velocity of the boom 110 as lift and tilt cylinders reach predetermined retracted positions to prevent the boom and bucket links from striking the boom 110 with a great amount of force. Although a graphical illustration of the lift control table is not shown, it will be apparent to one skilled in the art how to populate such a look-up table to achieve the desired results.

Thus, while the present invention has been particularly shown and described with reference to the preferred embodiment above, it will be understood by those skilled in the art that various additional embodiments may be contemplated without departing from the spirit and scope of the present invention.

INDUSTRIAL APPLICABILITY

Earth working machines such as wheel type loaders and excavators include work implements capable of being moved through a number of positions during a work cycle. The typical work cycle includes positioning the boom and bucket in a digging position for filling the bucket with material, a dumping position where the boom is raised and the bucket is tilted forward for removing material from the bucket, and a carrying position where the boom is being lowered and the bucket is tilted back in a racked position.

The present invention provides a method and apparatus for automatically limiting the velocity of the boom during a dumping and lowering operation to reduce the excessive forces attributed to bucket 108 from "slamming" into the boom 110; thereby, preventing damage to the work implement and the excessive "jerk" felt by the operator.

It should be understood that while the function of the preferred embodiment is described in connection with the boom and associated hydraulic circuits, the present invention is readily adaptable to control the position of implements for other types of earth working machines. For example, the present invention could be employed to control implements on hydraulic excavators, backhoes, and similar machines having hydraulically operated implements.

Other aspects, objects and advantages of the present invention can be obtained from a study of the drawings, the disclosure and the appended claims.

What is claimed is:

1. An apparatus for controllably moving a work implement of an earth moving machine, the work implement including a boom and a bucket being attached thereto where the boom is actuated by a hydraulic lift cylinder and the bucket is actuated by a hydraulic tilt cylinder, comprising:

an operator controlled joystick that produces an operator command signal for controlling the movement of the work implement;

implement position sensors that sense the elevational position of the boom and the pivotal position of the bucket, and responsively produce respective implement position signals;

a controller that receives the implement position and operator command signals, determines the instant position of the work implement, reduces the operator command signal as the boom is being moved and the bucket is being pivoted, and produces an electrical valve signal based on the reduced operator command signal, such that the movement of the boom is quickly stopped as the bucket pivots within a predetermined distance of the boom; and valve assembly that receives the electrical valve signal and controllably provides hydraulic fluid flow to the respective hydraulic cylinders in response to a magnitude of the electrical valve signal.

2. An apparatus, as set forth in claim 1, including a lift control table that stores a look-up table including a plurality of implement position values corresponding to a plurality of scaling values.

3. An apparatus, as set forth in claim 2, wherein the controller selects a value from the respective look-up table in response to the respective work implement position, multiplies the value by the magnitude of the operator command signal, and responsively produces the electrical valve signal having a magnitude equal to the product.

4. An apparatus, as set forth in claim 3, wherein the implement position signal corresponding to the elevational position of the boom is indicative of the lift cylinder extension, and the implement position signal corresponding to the pivotal position of the bucket is indicative of the tilt cylinder extension.

5. An apparatus, as set forth in claim 4, wherein the lift control table represents a three-dimensional look-up table that stores a plurality of scaling values that correspond to the extensions of the lift and the tilt cylinders.

6. An apparatus, as set forth in claim 5, wherein the controller includes kinematic tables representing two-dimensional look-up tables that store a plurality of angular values that correspond to a plurality of cylinder extensions, wherein the kinematic tables convert angular information of the implement position signals into linear positional information that represent the extension of the lift and tilt cylinders.

7. An apparatus, as set forth in claim 6, wherein the lift control table receives the converted implement position signals and produces a scaling value in response to the extension of the lift and tilt cylinders.

8. An apparatus, as set forth in claim 7, wherein the controller multiplies the scaling value by the operator lift command to produce the electrical valve signal to reduce the elevational velocity of the boom during a dumping operation when the bucket is being pivoted forward.

9. An apparatus, as set forth in claim 8, wherein the controller multiplies the scaling value by the operator lift command to produce the electrical valve signal to reduce the elevational velocity of the boom during a lowering operation when the bucket is being pivoted backward.

10. A method for controllably moving a work implement of an earth moving machine in response to the position of an operator controlled joystick, the work implement including a boom and a bucket being attached thereto, the work implement including a hydraulic lift cylinder for lifting and lowering the boom and a hydraulic tilt cylinder for dumping and racking the bucket, comprising the steps of:

sensing the positions of the lift and tilt cylinders and producing respective implement position signals;

receiving the implement position signals and operator command signal, reducing the operator command signal in response to a predetermined position of the lift and tilt cylinder, and producing an electrical valve signal based on the reduced operator command signal to reduce the elevational velocity of the boom as the bucket pivots to a predetermined angular position, such that the movement of the boom is quickly stopped as the bucket pivots within a predetermined distance of the boom; and receiving the electrical valve signal and controllably providing hydraulic fluid flow to the respective hydraulic cylinders in response to a magnitude of the electrical valve signal.

11. A method, as set forth in claim 10, including the steps of storing a lift control table that stores a plurality of scaling values that correspond to the position of the lift and the tilt cylinders.

12. A method, as set forth in claim 11, including the step of selecting a scaling value from the lift control table in response to the respective lift and tilt cylinder positions, multiplying the scaling value by the magnitude of the operator command signal, and responsively producing the electrical valve signal having a magnitude equal to the product of the multiplication.

13. A method, as set forth in claim 12, wherein the scaling value is equal to or less than 1.0.

14. A method for controllably moving a work implement of an earth moving machine in response to the position of an operator controlled joystick, the work implement including a boom and a bucket being attached thereto, the work implement including a hydraulic lift cylinder for lifting and lowering the boom and a hydraulic tilt cylinder for pivoting the bucket, comprising the steps of:

sensing the positions of the lift and tilt cylinders and producing respective implement position signals;

receiving the implement position signals and operator command signal, reducing the operator command signal in response to a predetermined position of the lift and tilt cylinder, and producing an electrical valve signal based on the reduced operator command signal to prevent the bucket from pivoting into the boom; and receiving the electrical valve signal and controllably providing hydraulic fluid flow to the respective hydraulic cylinders in response to a magnitude of the electrical valve signal.

15. A method, as set forth in claim 14, including the step of reducing the operator command signal to limit the velocity of the boom in response to boom being raised and the bucket being pivoted into a dumping position.

16. A method, as set forth in claim 15, including the step of reducing the operator command signal to limit the velocity of the boom in response to boom being lowered and the bucket being pivoted into a racked position.

17. A method for controllably moving a work implement of an earth moving machine in response to the position of an operator controlled joystick, the work implement including a boom and a bucket being attached thereto, the work implement including a hydraulic lift cylinder for lifting and lowering the boom and a hydraulic tilt cylinder for pivoting into the bucket, comprising the steps of:

sensing the positions of the lift and tilt cylinders and producing respective implement position signals;

receiving the implement position signals and operator command signal, reducing the operator command signal as the boom is being moved and the bucket is being pivoted, and producing an electrical valve signal based on the reduced operator command signal, such that the movement of the boom is quickly stopped as the bucket pivots within a predetermined distance of the boom; and receiving the electrical valve signal and controllably providing hydraulic fluid flow to the respective hydraulic cylinders in response to a magnitude of the electrical valve signal.

18. A method, as set forth in claim 17, including the step of reducing the operator command signal to limit the velocity of the boom in response to boom being raised and the bucket being pivoted into a dumping position.

19. A method, as set forth in claim 17, including the step of reducing the operator command signal to limit the velocity of the boom in response to boom being lowered and the bucket being pivoted into a racked position.

* * * * *